US006837232B2

(12) United States Patent
Yamashita

(10) Patent No.: US 6,837,232 B2
(45) Date of Patent: Jan. 4, 2005

(54) AIR-FUEL RATIO CONTROL APPARATUS FOR INTERNAL COMBUSTION ENGINE

(75) Inventor: Yukihiro Yamashita, Takahama (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/638,486

(22) Filed: Aug. 12, 2003

(65) Prior Publication Data

US 2004/0050378 A1 Mar. 18, 2004

(30) Foreign Application Priority Data

Sep. 17, 2002 (JP) ..... 2002-269342

(51) Int. Cl.[7] ..... F02D 41/12; F02D 41/14

(52) U.S. Cl. ..... 123/694; 123/675; 123/326; 123/344; 701/109; 60/276

(58) Field of Search ..... 123/326, 693, 123/694, 344, 674, 675; 701/109; 60/276

(56) References Cited

U.S. PATENT DOCUMENTS 4,546,747 A 10/1985 Kobayashi et al.
5,396,765 A * 3/1995 Maruyama et al. ..... 60/276
5,778,866 A 7/1998 Uchikawa
5,964,208 A * 10/1999 Yamashita et al. ..... 123/674
2001/0006062 A1 * 7/2001 Wakui et al. ..... 123/694

* cited by examiner

*Primary Examiner*—Erick Solis
(74) *Attorney, Agent, or Firm*—Nixon & Vanderhye P.C.

(57) ABSTRACT

When in controlling an air-fuel ratio by a feedback control, a target air-fuel ratio is changed between normal time and at rich control time, a difference between a change amount of the target air-fuel ratio and a change amount of an air-fuel ratio feedback correction coefficient is learned as a sensor error in the rich control. A final detected air-fuel ratio is calculated by correcting a detected air-fuel ratio of an air-fuel ratio sensor in rich control based on the sensor error. Alternatively, the target air-fuel ratio or the air-fuel ratio feedback correction coefficient in the rich control may be corrected based on the sensor error.

6 Claims, 8 Drawing Sheets

AIR-FUEL RATIO CONTROL APPARATUS FOR INTERNAL COMBUSTION ENGINE

CROSS REFERENCE TO RELATED APPLICATION

This application is based on and incorporates herein by reference Japanese Patent Application No. 2002-269342 filed on Sep. 17, 2002.

FILED OF THE INVENTION

The present invention relates to an air-fuel ratio control apparatus for an internal combustion engine having a function of learning an error in an output of an air-fuel ratio sensor for detecting an air-fuel ratio of emission gas of the internal combustion engine.

BACKGROUND OF THE INVENTION

In recent years, in an internal combustion engine mounted on a vehicle, a target air-fuel ratio of emission gas is set to the vicinity of the stoichiometric air-fuel ratio which is the highest cleaning performance range of a catalyst of a three-way catalyst or the like, and an air-fuel ratio is controlled by a feedback control such that an air-fuel ratio of emission gas detected by an air-fuel ratio sensor becomes the target air-fuel ratio to thereby promote an emission gas cleaning efficiency of the catalyst.

Further, according to a vehicle in recent years, fuel cut-off for stopping fuel injection in deceleration operation or the like is carried out to improve fuel cost. During the fuel cut-off, intake air is discharged from an engine into an exhaust pipe without being subjected to combustion. Therefore, oxygen in uncombusted emission gas is brought into a state of being adsorbed in the catalyst by a large amount. Therefore, after finishing the fuel cut-off, even when an air-fuel ratio of emission gas is controlled by a feedback control to the vicinity of the stoichiometric air-fuel ratio which is an ordinary target air-fuel ratio, a cleaning function inherent to the catalyst cannot be achieved by the large amount of oxygen adsorbed in the catalyst during the fuel cut-off.

Hence, according to a vehicle in recent years, after finishing the fuel cut-off, the target air-fuel ratio is shifted temporarily in a direction richer than the stoichiometric air-duel ratio and rich control for controlling the air-fuel ratio of emission gas to be richer than the stoichiometric air-fuel ratio is carried out to thereby make the oxygen adsorbed in the catalyst react with HC in emission gas to be removed to recover the cleaning function which the catalyst possesses.

Generally, the output characteristic of an air-fuel ratio sensor has a characteristic that although an air-fuel ratio can be detected with high accuracy when an error (tolerance) with respect to a standard output characteristic becomes substantially null at the vicinity of the stoichiometric air-fuel ratio (excess air ratio $\lambda=1$), the more remote from the stoichiometric air-fuel ratio, the more enlarged the detection error with respect to the standard output characteristic to thereby deteriorate detection accuracy. Therefore, in the above rich control after finishing the fuel cut-off, even when the air-fuel ratio of emission gas is controlled by a feedback control to a target air-fuel ratio $\lambda tg$ richer than the stoichiometric air-fuel ratio, since the detection accuracy of the air-fuel ratio sensor is poor in the rich air-fuel region, the air-fuel ratio of emission gas cannot be controlled accurately to the target air-fuel ratio $\lambda tg$ in the rich control. As a result, the actual air-fuel ratio $\lambda r$ of emission gas is shifted to a side richer than the target air-fuel ratio $\lambda tg$ in the rich control, an emission amount of a component rich in CO, HC or the like is increased, or, the actual air-fuel ratio $\lambda r$ for emission gas is shifted to a side leaner than the target air-fuel ratio $\lambda tg$ in the rich control to thereby increase an emission amount of NOx.

For compensating for an error in an output of an air-fuel ratio sensor, in for example U.S. Pat. No. 5,778,866 (JP-A-9-203343), a change characteristic (inclination characteristic) of an output of an air-fuel ratio sensor is learned until elapse of a predetermined time period from start of fuel cut-off, the change characteristic is compared with a previously determined reference change characteristic (inclination characteristic) to form correction data and the output of the air-fuel ratio sensor is corrected by the correction data.

However although according to the sensor output correcting method, the change characteristic of the air-fuel ratio sensor is learned after starting the fuel cut-off, the change characteristic of the output of the air-fuel ratio sensor is changed also by a factor other than the error of the output of the air-fuel ratio sensor (for example, an emission gas flow rate, a state of adsorbing a lean/rich component or a degree of deterioration thereof at start of the fuel cut-off, or the like). Therefore, even when the change characteristic of the output of the air-fuel ratio sensor is measured after starting the fuel cut-off, the error of the output of the air-fuel ratio sensor cannot accurately be learned and correction accuracy of the output of the air-fuel ratio sensor is poor.

Further, in U.S. Pat. No. 4,546,747 (JP-2503381), an actual limit current of an air-fuel ratio sensor is detected in a specific operating state (for example, a steady-state operating state at low or middle load), a deviation between the actual limit current (detected air-fuel ratio) and a target limit current (target air-fuel ratio) previously stored in correspondence with the specific operating state is calculated, a correction coefficient is calculated based on the deviation and the output of the air-fuel ratio sensor is corrected by the correction coefficient.

However, although according to the sensor output correcting method, the correction coefficient is calculated based on the deviation between the actual limit current (detected air-fuel ratio) of the air-fuel ratio sensor and the previously stored target limit current (target air-fuel ratio) in the specific operating state, during the feedback control of the air-fuel ratio, the feedback control is carried out such that the actual limit current (detected air-fuel ratio) of the air-fuel ratio sensor coincides with the target limit current (target air-fuel ratio). Therefore, the deviation between the actual limit current (detected air-fuel ratio) of the air-fuel ratio sensor and the target limit current (target air-fuel ratio) is reduced, the error of the output of the air-fuel ratio sensor cannot accurately be learned and the correction accuracy of the output of the air-fuel ratio sensor is still poor.

SUMMARY OF THE INVENTION

It is an object of the present invention to provide an air-fuel ratio control apparatus of an internal combustion engine capable of accurately learning an error of an output of an air-fuel ratio sensor in an air-fuel ratio feed back control system.

According to an air-fuel ratio control apparatus of the invention, in a system for executing an air-fuel ratio feedback control such that an air-fuel ratio of an emission gas detected by an air-fuel sensor coincides with a target air-fuel ratio, when the target air-fuel ratio is changed in executing the air-fuel ratio feedback control, an error (sensor error) of an output of the air-fuel ratio sensor is learned by sensor error learning means based on target air-fuel ratios and air-fuel ratio feedback correction coefficients before and after the change.

When the target air-fuel ratio is changed during the air-fuel ratio feedback control, the air-fuel ratio feedback correction coefficient is changed from an air-fuel ratio feedback correction coefficient for making a detected air-fuel ratio of the air-fuel ratio sensor coincide with the target air-fuel ratio before the change to the air-fuel ratio feedback correction coefficient for making the detected air-fuel ratio coincide with the target air-fuel ratio after the change. At this occasion, when there is not any sensor error, a rate of changing the target air-fuel ratio and a rate of changing the air-fuel ratio feedback correction coefficient become substantially equal to each other. However, when there is the sensor error (error of detected air-fuel ratio), the rate of changing the air-fuel ratio feedback correction coefficient is different from the rate of changing the target air-fuel ratio by an amount in accordance with the sensor error. Therefore, in changing the target air-fuel ratio, when the target air-fuel ratios and the air-fuel ratio feedback correction coefficients before and after the change are used, the rate of changing the target air-fuel ratio and the rate of changing the air-fuel ratio feedback correction coefficient are calculated and the sensor error can accurately be learned from a difference between the rates of changing the both.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS (First Embodiment)

Figure 1:
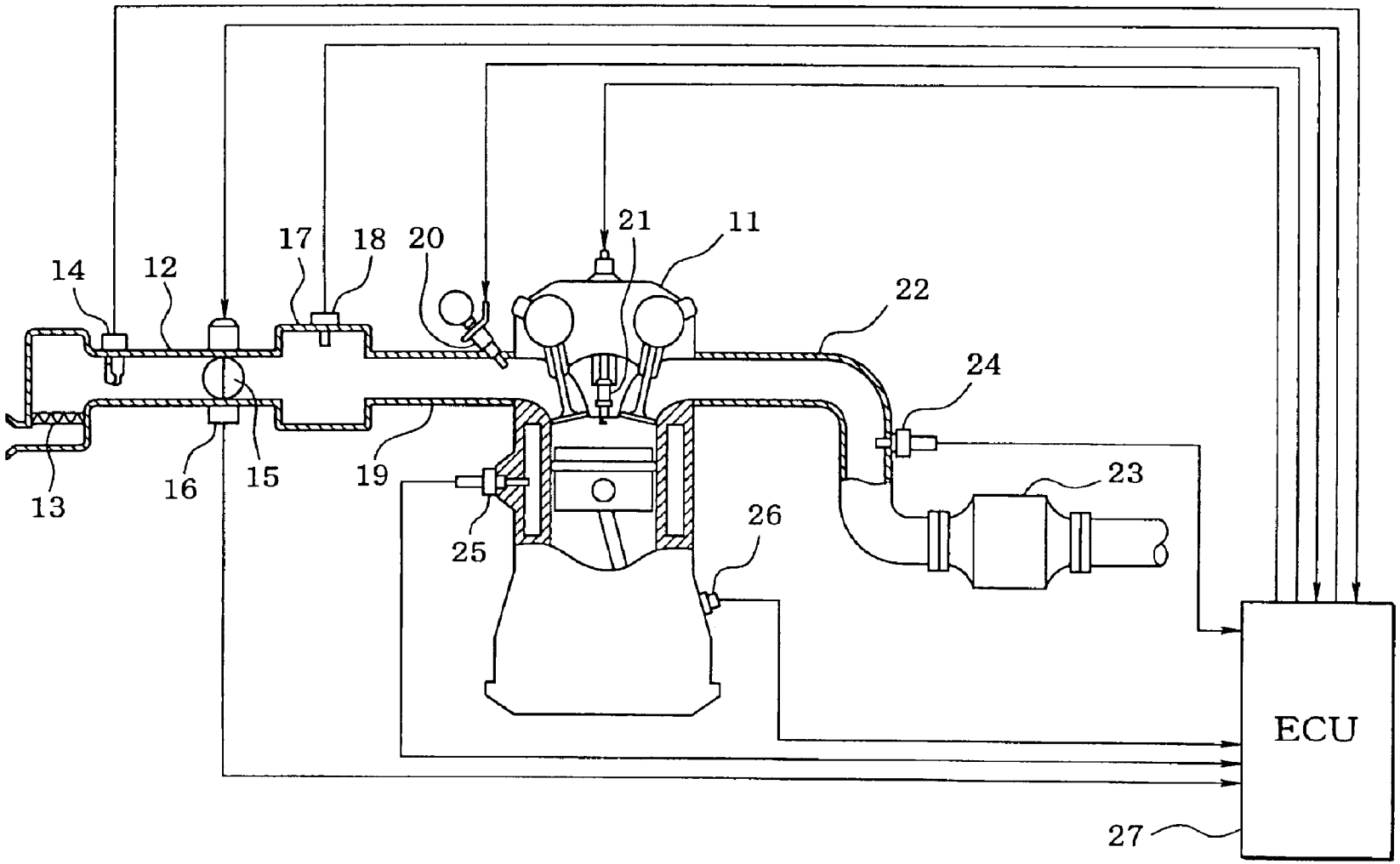
FIG. 1 is a schematic diagram of an engine control system according to the first embodiment of the invention.

Referring first to FIG. 1, an air cleaner 13 is provided at the most upstream portion of an intake pipe 12 of an internal combustion engine 11, and an air flow meter 14 for detecting an intake air mount is provided on the downstream side of the air cleaner 13. A throttle valve 15 an opening of which is controlled by a DC motor and a throttle opening degree sensor 16 for detecting the throttle opening degree are provided on the downstream side of the air flow meter 14.

Further, a surge tank 17 is provided on the downstream side of the throttle valve 15 and the surge tank 17 is provided with an intake pipe pressure sensor 18 for detecting an intake pipe pressure. Further, the surge tank 17 is provided with an intake manifold 19 for introducing air to respective cylinders of the engine 11, and fuel injection valves 20 for respectively injecting fuel are attached to vicinities of intake ports of the intake manifold 19 of the respective cylinders. Further, an ignition plug 21 is attached to a cylinder head of the engine 11 for each cylinder so that a mixture in the cylinder is ignited by spark discharge of each ignition plug 21.

Meanwhile, an exhaust pipe 22 of the engine 11 is provided with a three-way catalyst 23 for cleaning CO, HC, NOx or the like in emission gas, and an air-fuel ratio sensor 24 of a limit current type for detecting an air-fuel ratio of emission gas is provided on the upstream side of the catalyst 23. Further, a cylinder block of the engine 11 is provided with a water temperature sensor 25 for detecting cooling water temperature and a crankshaft angle sensor 26 for outputting a pulse signal at each rotation of a crankshaft of the engine 11 by a constant crankshaft angle (for example, 30° CA). A crankshaft angle and engine rotational speed are detected based on an output signal of the crankshaft angle sensor 26.

Outputs of the above various sensors are inputted to an engine control circuit (ECU) 27. ECU 27 is mainly constructed by a microcomputer for controlling a fuel injection amount of the fuel injection valve 20 and an ignition timing of the ignition plug 21 in accordance with an engine operating state by executing various engine control programs stored in a built-in ROM (storage medium).

According to programs of the embodiment explained below, the excess air ratio λ, which is a rate of an actual air-fuel ratio to the stoichiometric air-fuel ratio is used as information of "air-fuel ratio".

Figure 3:
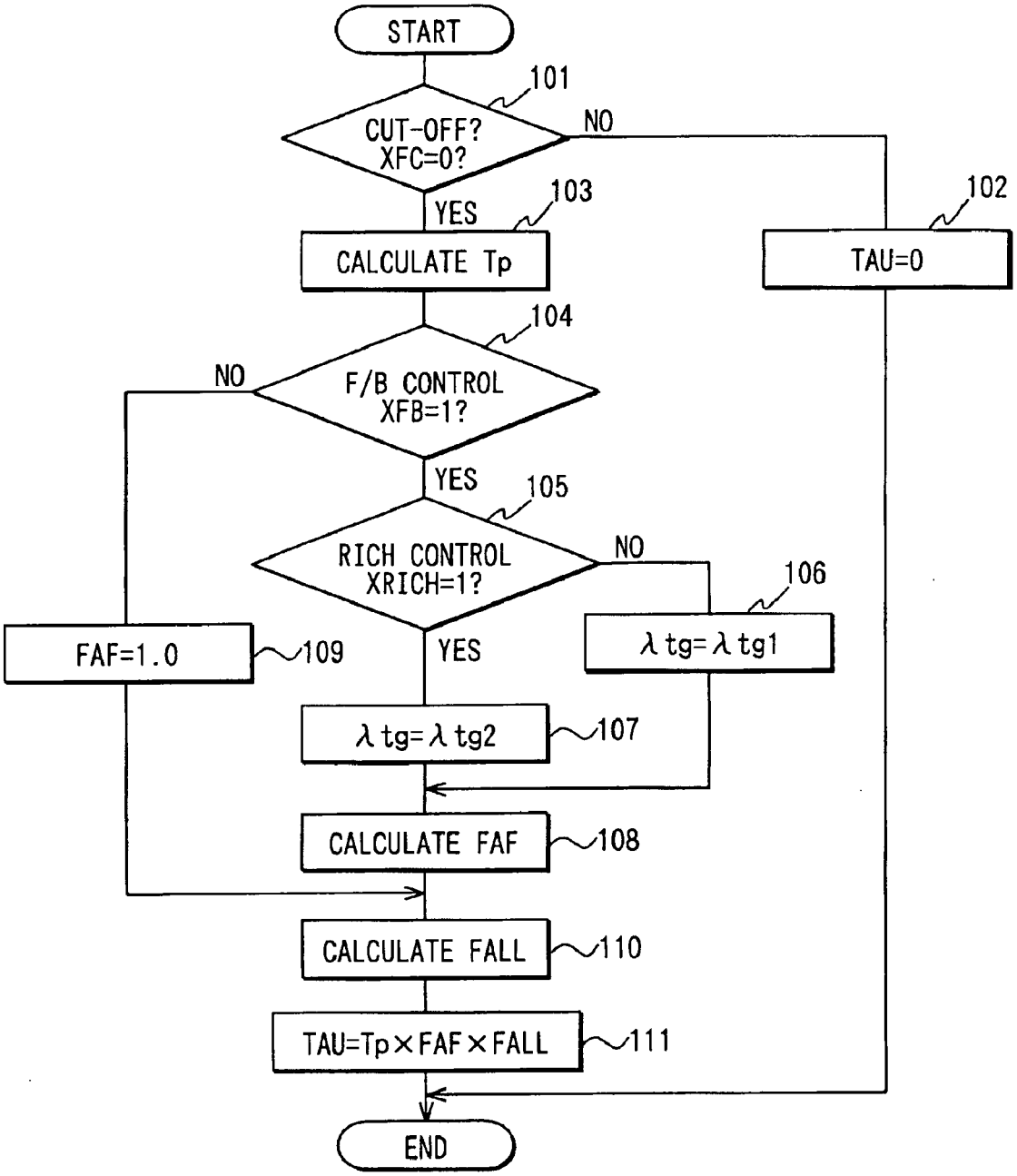
FIG. 3 is a flowchart showing processing of a fuel injection amount calculating routine.

ECU 27 executes an air-fuel ratio feedback (F/B) control upon establishing a condition of executing the air-fuel ratio F/B control by executing a fuel injection amount calculating routine shown in FIG. 3. During the air/fuel ratio F/B control, generally, a target air/fuel ratio λtg of emission gas is set to the vicinity of the stoichiometric air-fuel ratio, which is the highest cleaning performance range of the three-way catalyst 23, an air-fuel ratio F/B correction coefficient FAF is calculated such that a detected air-fuel ratio λs of emission gas detected by the air-fuel ratio sensor 24 coincides with the target air-fuel ratio λtg, and a fuel injection amount TAU is calculated by using the air-fuel ratio F/B correction coefficient FAF.

Further, upon establishing a condition of executing fuel cut-off of deceleration operation or the like, fuel cut-off for stopping fuel injection is executed. During the air-fuel ratio F/B control after finishing the fuel cut-off, by carrying out rich control by shifting the target air-fuel ratio λtg temporarily in a direction richer than the stoichiometric air-fuel ratio and controlling the detected air-fuel ration λs of the air-fuel ratio sensor 24 to a target air-fuel ratio richer than the stoichiometric air-fuel ratio by F/B control, oxygen adsorbed in the catalyst 23 during the fuel cut-off is made to react with HC in emission gas to remove to thereby recover the cleaning function of the catalyst 23.

Figure 2:
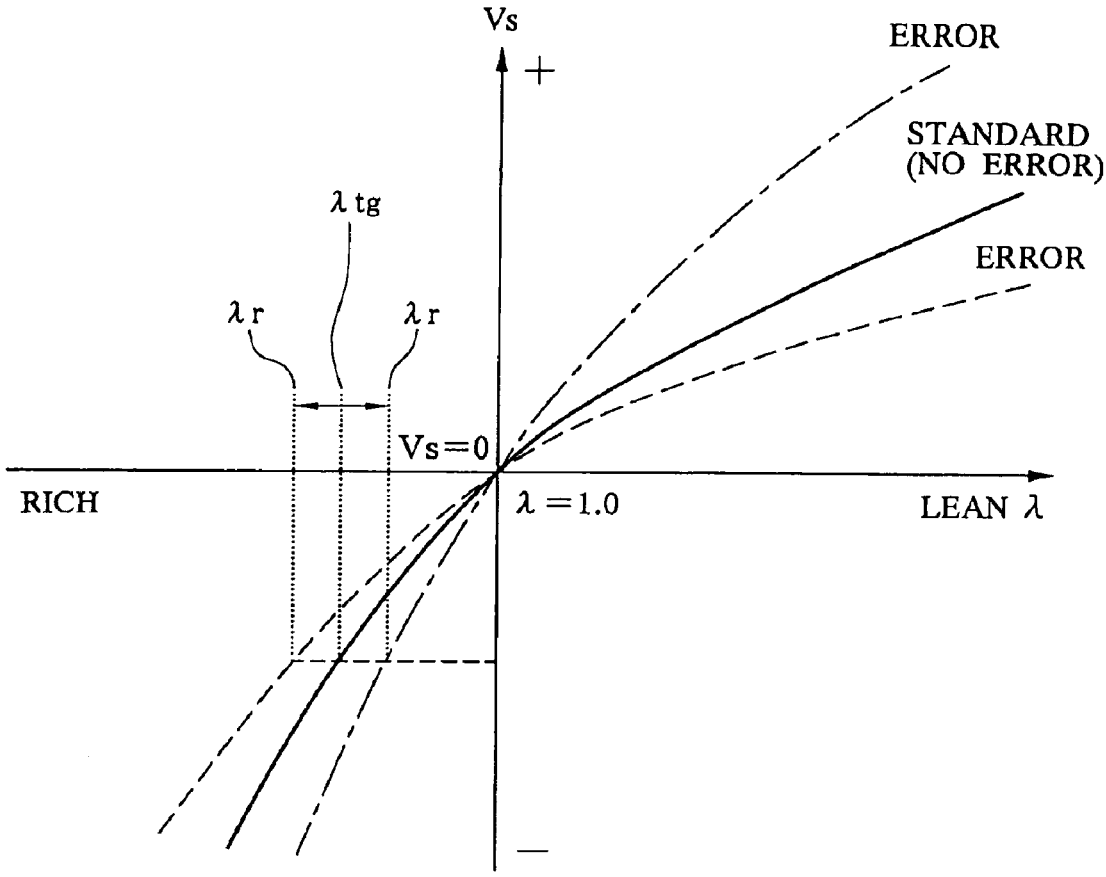
FIG. 2 is an output characteristic diagram of an air-fuel ratio sensor.

Generally, as shown in FIG. 2, the output characteristic of the air-fuel ratio sensor 24 is provided with the characteristic in which although at the vicinity of the stoichiometric air-fuel ratio (λ=1.0), the air-fuel ratio can be detected with high accuracy since an error with respect to a standard output characteristic becomes substantially null, the more remote from the stoichiometric air-fuel ratio, the more enlarged the detection error with respect to the standard output characteristic to thereby deteriorate detection accuracy. In the above-described rich control after finishing the fuel cut-off, the air-fuel ratio of emission gas is controlled to the target air-fuel ratio λtg richer than the stoichiometric air-fuel ratio by F/B control. Therefore, the detection accuracy of the air-fuel ratio sensor 24 tends to deteriorate to thereby deteriorate accuracy of the air-fuel ratio F/B control. An actual air-fuel ratio λr of emission gas is shifted from the target air-fuel ratio λtg in the rich control.

Figure 4:
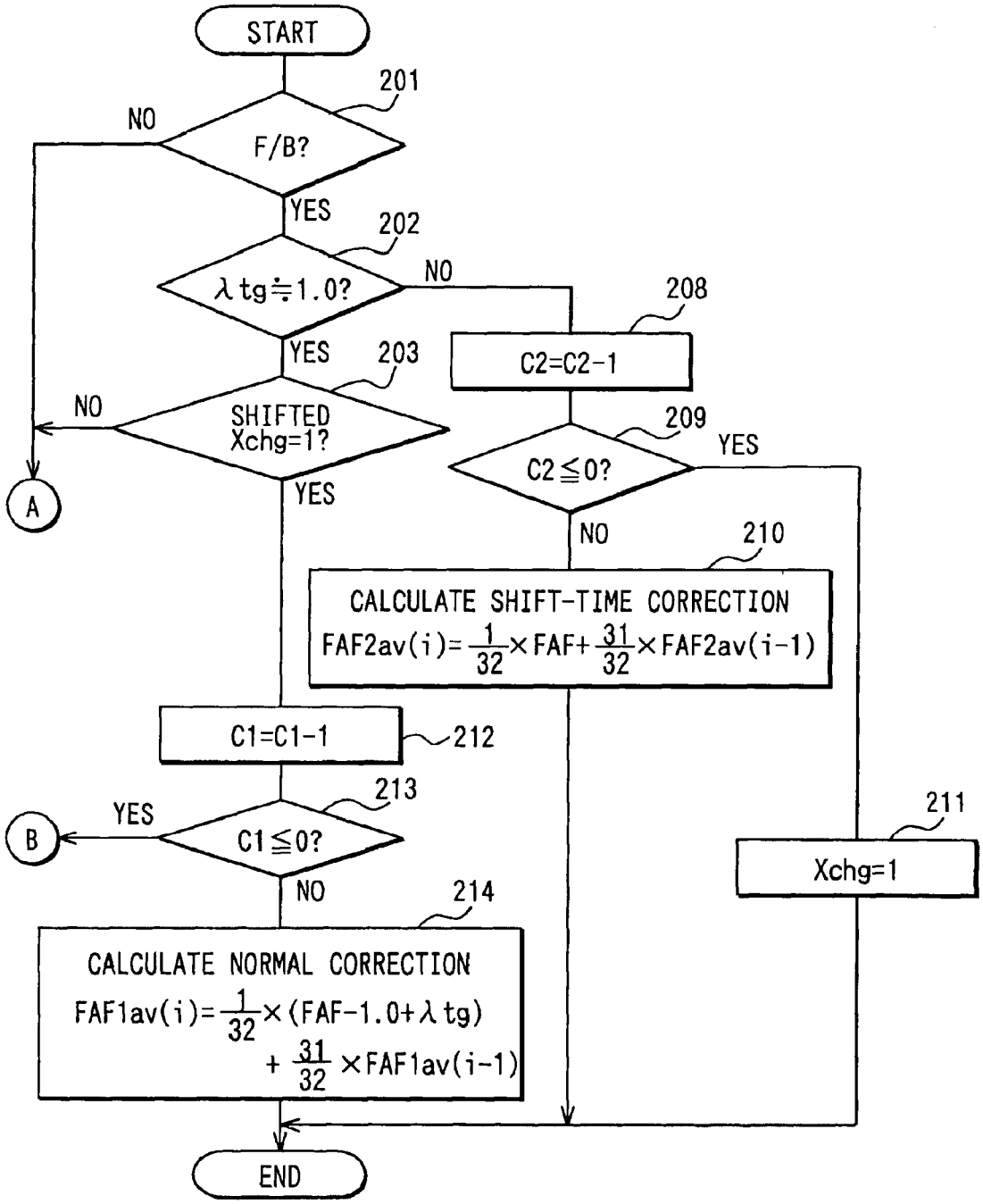
FIG. 4 is a flowchart showing processing of a sensor error and correction coefficient calculating routine (part 1)
Figure 5:
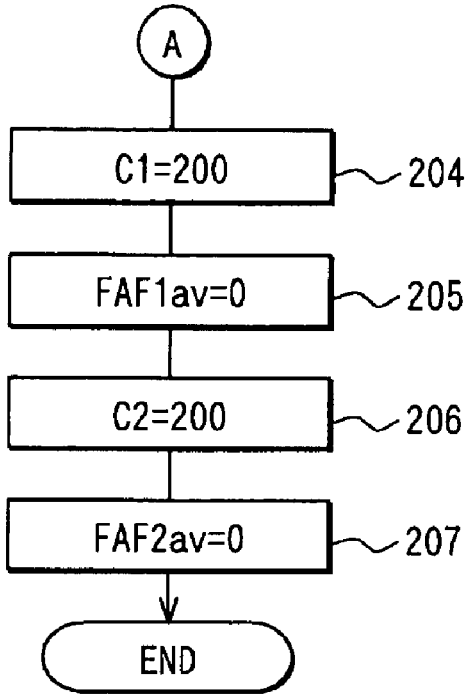
FIG. 5 is a flowchart showing processing of the sensor error and correction coefficient calculating routine (part 2)
Figure 6:
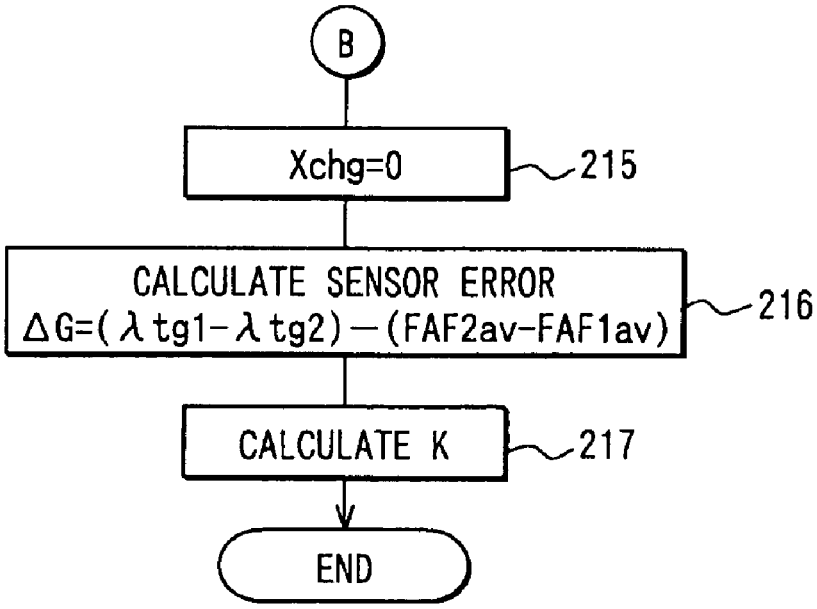
FIG. 6 is a flowchart showing processing of the sensor error and correction coefficient calculating routine (part 3)

Hence, by executing a sensor error and correction coefficient calculating routine shown in FIG. 4 through FIG. 6, at each time of changing the target air-fuel ratio λtg in executing the air-fuel ratio A/F control, ECU 27 calculates a sensor ΔG of the output of the air-fuel ratio sensor 24 based on the target air-fuel ratios λtg1 and λtg2 and the air-fuel ratio F/B correction coefficients FAF1 and FAF2 before and after the change, and calculates a correction coefficient K for correcting the detected air-fuel ratio λs of the air-fuel ratio sensor 24 based on the sensor error ΔG.

Figure 7:
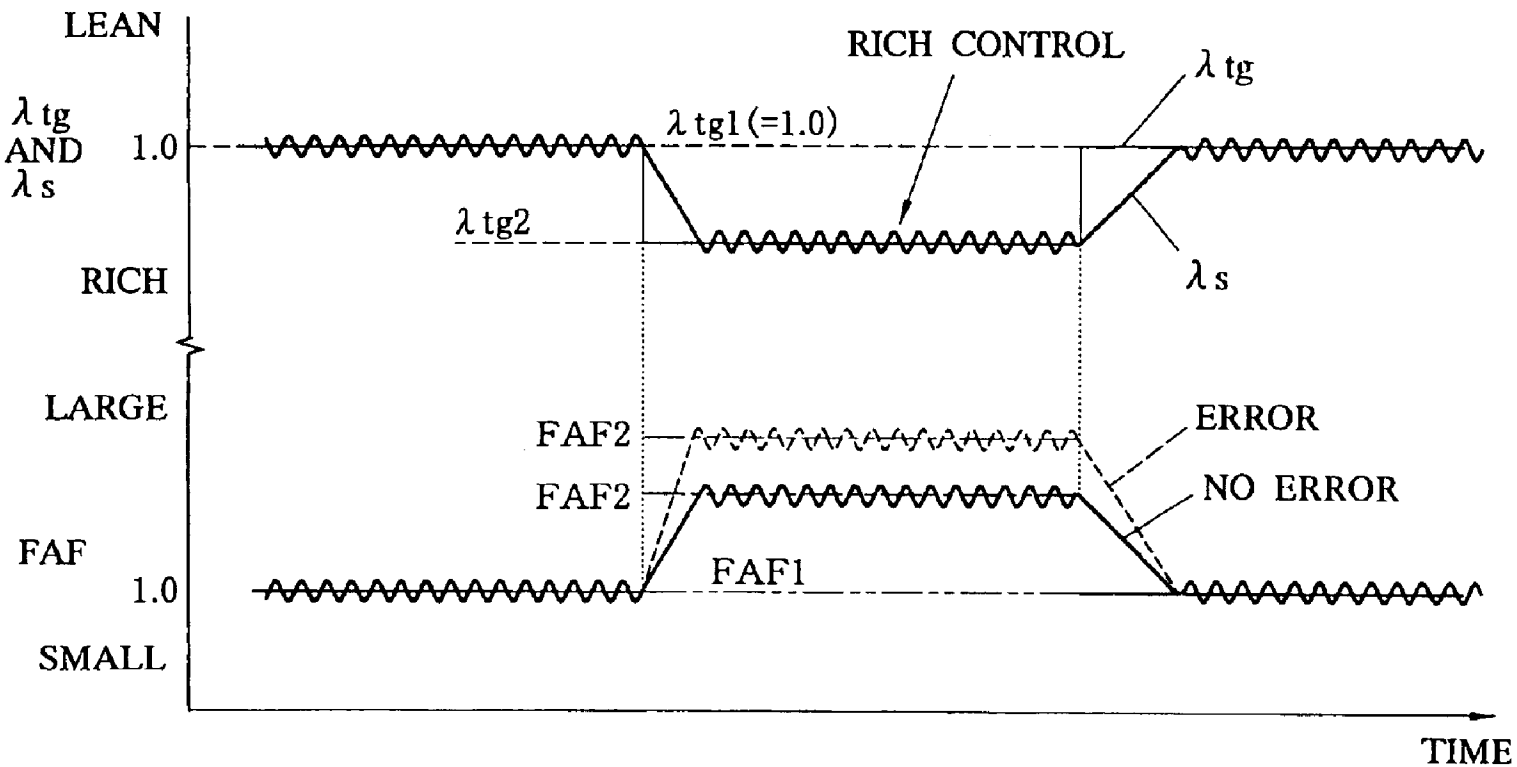
FIG. 7 is a time chart showing a method of calculating a sensor error ΔG.

Here, a method of calculating the sensor error ΔG of the air-fuel ratio sensor 24 and a method of correcting the detected air-fuel ratio λs of the air-fuel ratio sensor 24 are described in reference to FIG. 7.

During the air-fuel ratio F/B control, when the target air-fuel ratio λtg is changed from λtg1 (=1.0) to λtg2, the air-fuel ratio F/B correction coefficient FAF is changed from the air-fuel ratio F/B correction coefficient FAF1 for making the detected air-fuel ratio λs of the air-fuel ratio sensor 24 coincide with the target air-fuel ratio λtg1 to the air-fuel ratio F/B correction coefficient FAF2 for making the detected air-fuel ratio λs coincide with the target air-fuel ratio λtg2. At this occasion, when there is not the sensor error ΔG (an error of the detected air-fuel ratio λs), a change amount (λtg1−λtg2) of the target air-fuel ratio and a change amount (FAF2−FAF1) of the air-fuel ratio F/B correction coefficient are substantially equal to each other. However, when there is the sensor error ΔG, the change amount (FAF2−FAF1) of the air-fuel ratio F/B correction coefficient differs from the change amount (λtg1−λtg2) of the target air-fuel ratio by an amount in accordance with the sensor error λG.

Hence, according to this embodiment, an error of the change amount (FAF2−FAF1) of the air-fuel ratio F/B correction coefficient relative to the change amount (λtg1−λtg2) of the target air-fuel ratio is calculated as the sensor error ΔG.

$$\Delta G=(\lambda tg\mathbf{1}-\lambda tg\mathbf{2})-(FAF\mathbf{2}-FAF\mathbf{1})$$

Further, a relationship between a change amount (λs2−λs1) of the detected air-fuel ratio λs and a change amount (λr2−λr1) of an actual air-fuel ratio λr is changed in accordance with the sensor error ΔG when the target air-fuel ratio λtg is changed from λtg1 to λtg2. Therefore, the relationship between the change amount (λs2−λs1) of the detected air-fuel ratio λs and the change amount (λr2−λr1) of the actual air-fuel ratio λr can be represented by the following equation by using a correction coefficient K in accordance with the sensor error ΔG.

$$(\lambda r\mathbf{2}-\lambda r\mathbf{1})=K\times(\lambda s\mathbf{2}-\lambda s\mathbf{1}) \quad \text{(A)}$$

Here, when the target air-fuel ratio λtg1 is the stoichiometric air-fuel ratio (λ=1.0), the sensor error ΔG=0 from the output characteristic of the air-fuel ratio sensor 24 shown in FIG. 2. Therefore, the detected air-fuel ratio becomes as λs1=1.0 and the actual air-fuel ratio becomes as λr1=1.0. From the relationship, when the target air-fuel ratio λtg1 is the stoichiometric air-fuel ratio (λ=1.0), the above-described equation (A) can be rewritten as the following equation.

$$(\lambda r\mathbf{2}-1.0)=K\times(\lambda s\mathbf{2}-1.0) \quad \text{(B)}$$

Further, when the detected air-fuel ratio λs2 is defined as a detected air-fuel ratio λs0 before correction and the actual air-fuel ratio λr2 is defined as the detected air-fuel ratio λs after correction, the above-described equation (B) can be rewritten as the following equation.

$$\lambda s=k\times(\lambda s\mathbf{0}-1.0)+1.0 \quad \text{(C)}$$

According to this embodiment, the final detected air-fuel ratio λs is calculated by correcting the detected air-fuel ratio λs0 of the air-fuel ratio fuel ratio sensor 24 by using the above-described equation (C).

Next, the processing of ECU 27 is described with reference to FIG. 3 to FIG. 6.

(Fuel Injection Amount Calculation)

The fuel injection amount calculating routine shown in FIG. 3 is executed, for example, at each fuel injection timing.

When the routine is started, first, at step 101, it is determined whether a fuel cut-off execution flag XFC is reset to "0". The fuel cut-off execution flag XFC is set to "1" when the condition of executing fuel cut-off is established such as executing deceleration operation.

When it is determined at step 101, that the fuel cut-off execution flag XFC is set to "1", the processing proceeds to step 102 and the fuel cut-off is executed by setting the fuel injection amount TAU to "0".

Meanwhile, when it is determined at step 101 that the fuel cut-off execution flag XFC is reset to "0", the processing proceeds to step 103, searches a mapped data of a basic fuel injection amount Tp (not illustrated) and calculates the basic fuel injection amount Tp in accordance with a current operating state (for example, engine rotational speed NE and intake pipe pressure PM).

Thereafter, the processing proceeds to step 104 and determines whether an air-fuel ratio F/B control execution flag XFB is set to "1". The air-fuel ratio F/B control execution flag XFB is set to "1" when conditions of executing the air-fuel ratio F/B control are established. The air-fuel ratio F/B control executing conditions are, for example, that the engine cooling water temperature is equal to or higher than predetermined temperature, that the engine operating state is not brought into a high rotation high load state and the like, and the air-fuel ratio F/B control executing conditions are established when all of the conditions are satisfied.

When it is determined at the step 104, that the air-fuel ratio F/B control execution flag XFB is reset to "0", the processing proceeds to step 109, sets the air-fuel ratio F/B correction coefficient FAF to "1.0" and thereafter proceeds to step 110. In this case, the F/B control of the air-fuel ratio is not carried out.

Meanwhile, when it is determined at step 104 that the air-fuel ratio F/B control execution flag XFB is set to "1", the processing proceeds to step 105 and determines whether a rich control execution flag XRICH is set to "1". The rich control execution flag XRICH is set to "1" only during a predetermined period of time after finishing the fuel cut-off.

When it is determined at step 105 that the rich control execution flag XRICH is reset to "0", the processing proceeds to step 106 and sets the target air-fuel ratio λtg to the target air-fuel ratio λtg1 at normal time. The target air-fuel ratio λtg1 at normal time is set to the stoichiometric air-fuel ratio or a value at vicinity thereof (for example, λ=1.0).

Meanwhile, when it is determined at step 105 that the rich control execution flag XRICH is set to "1", the processing proceeds to step 107 and sets the target air-fuel ratio λtg to the target air-fuel ratio λtg2 in rich control. The target air-fuel ratio λtg2 in the rich control is set to a value shifted in a direction richer than the stoichiometric air-fuel ratio (for example, λ=0.96).

Thereafter, the processing proceeds to step 108, calculates the air-fuel ratio F/B correction coefficient FAF such that the detected air-fuel ratio λs of emission gas detected by the air-fuel ratio sensor 24 coincides with the target air-fuel ratio λtg. The processing thereafter proceeds to step 110 and calculates other correction coefficient FALL in accordance with the cooling water temperature, electric load and the like.

Thereafter, the processing proceeds to step 111 and calculates the fuel injection amount TAU by the following equation by using the basic fuel injection amount Tp, the air-fuel ratio F/B correction coefficient FAF and the other correction coefficient FALL.

$$TAU=Tp\times FAF\times FALL$$

(Sensor Error and Correction Coefficient Calculation)

A sensor error and correction coefficient calculating routine shown in FIG. 4 through FIG. 6 is executed, for example, at each fuel injection timing.

When the routine is started, first, it is determined at step 201 whether the air-fuel ratio F/B control is being executed. When it is determined that the air-fuel ratio F/B control is not being executed as a result, the processing proceeds to step 204 of FIG. 5 to sets a counter value C1 for counting an operation time period of an air-fuel ratio F/B correction coefficient average value FAF1av at normal time (target air-fuel ratio λtg=1.0) to a predetermined value (for example, 200). Thereafter it proceeds to step 205 to resets the air-fuel ratio F/B correction coefficient average value FAF1av at normal to "0".

Thereafter, the processing proceeds to step 206, resets a counter C2 for counting an operation time period of an air-fuel ratio F/B correction coefficient average value FAF2av in shifting to the target air-fuel ratio to an initial value (for example, 200). Thereafter it proceeds to step 207 and resets the air-fuel ratio F/B correction coefficient average value FAF2av in shifting to the target air-fuel ratio to "0" to thereby finish the routine.

Meanwhile, at step 201 of FIG. 4, when it is determined that the air-fuel ratio F/B control is being executed, the processing proceeds to step 202 and determines whether the target air-fuel ratio λtg is brought to the vicinity of the stoichiometric air-fuel ratio (for example, within a range of 0.98 through 1.01).

When the target air-fuel ratio λtg is set to the target air-fuel ratio λtg1 at normal time (for example, 1.0), at step 202, it is determined as "Yes", the processing proceeds to step 203 and determines whether a target air-fuel ratio shifted flag Xchg is set to "1". When it is determined that the target air-fuel ratio shifted flag Schg is not set to "1" yet as a result, the processing proceeds to step 204 of FIG. 5.

Thereafter, when the target air-fuel ratio λtg is shifted to the target air-fuel ratio λtg2 (for example, 0.96) in shifting to the target air-fuel ratio (for example, in rich control), it is determined as "No" at step 202. The processing proceeds to step 208 to decrement a count value of the counter C2 for counting the operation time period of the air-fuel ration F/B correction coefficient average value FAF2av in shifting to the target air-fuel ratio by "1". It thereafter proceeds to step 209 and determines whether the count value of the counter C2 becomes equal to or smaller than 0.

When it is determined that the counter C2 is not equal to or smaller than 0 as a result, the processing proceeds to step 210 and calculates the air-fuel ratio F/B correction coefficient average value FAF2av (rounded value) in shifting to the target air-fuel ratio by the following equation.

$$FAF2av(i)=1/32\times FAF+31/32\times FAF2av(i-1)$$

Here, notation FAF2av(i) designates the air-fuel ratio F/B correction coefficient average value at current time, notation FAF2av(i−1) designates the air-fuel ratio F/B correction coefficient average value at preceding time, and notation FAF designates the current air-fuel ratio F/B correction coefficient.

Thereafter, at step 209, when it is determined that the counter C2 becomes equal to or smaller than 0, the processing proceeds to step 211 and sets the target air-fuel ratio shifted flag Xchg to "1".

Thereafter, when the rich control has been finished and the target air-fuel ratio λtg is recovered to the target air-fuel ratio λtg1 at normal time (for example, 1.0), it is determined as "Yes" both at steps 202 and 203 of FIG. 4, the processing proceeds to step 212, decrements a count value of the counter value C1 for counting the operation time period of the air-fuel ratio F/B correction coefficient average value FAF1av at normal time by "1". It thereafter proceeds to step 213 and determines whether the count value of the counter value C1 becomes equal to or smaller than 0.

When it is determined that the counter value C1 does not become equal to or smaller than 0 as a result, the processing proceeds to step 214 and calculates the air-fuel ratio F/B correction coefficient average value FAF1av (rounded value) at normal time by the following equation.

$$FAF1av(i)=1/32\times(FAF-1.0+\lambda tg)+31/32\times FAF1av(i-1)$$

Here, Notation FAF1av(i) designates the air-fuel ratio F/B correction coefficient average value at current time, notation FAF1av(i−1) designates the air-fuel ratio F/B correction coefficient average value at preceding time and notation FAF designates the current air-fuel ratio F/B correction coefficient.

Thereafter, when it is determined at step 213 that the counter value C1 becomes equal to or smaller than 0, the processing proceeds to step 215 of FIG. 6 and resets the target air-fuel ratio shifted flag Xchg to "0".

Thereafter, the processing proceeds to step 216, calculates a difference between the change amount (λtg1−λtg2) of the target air-fuel ratio and the change amount (FAF2av−FAF1av) of the air-fuel ratio F/B correction coefficient average value as the sensor element ΔG and stores the difference to memory of ECU 27 as a learning value of the sensor error ΔG $$\Delta G=(\lambda tg1-\lambda tg2)-(FAF2av-FAF1av)$$

Figure 8:
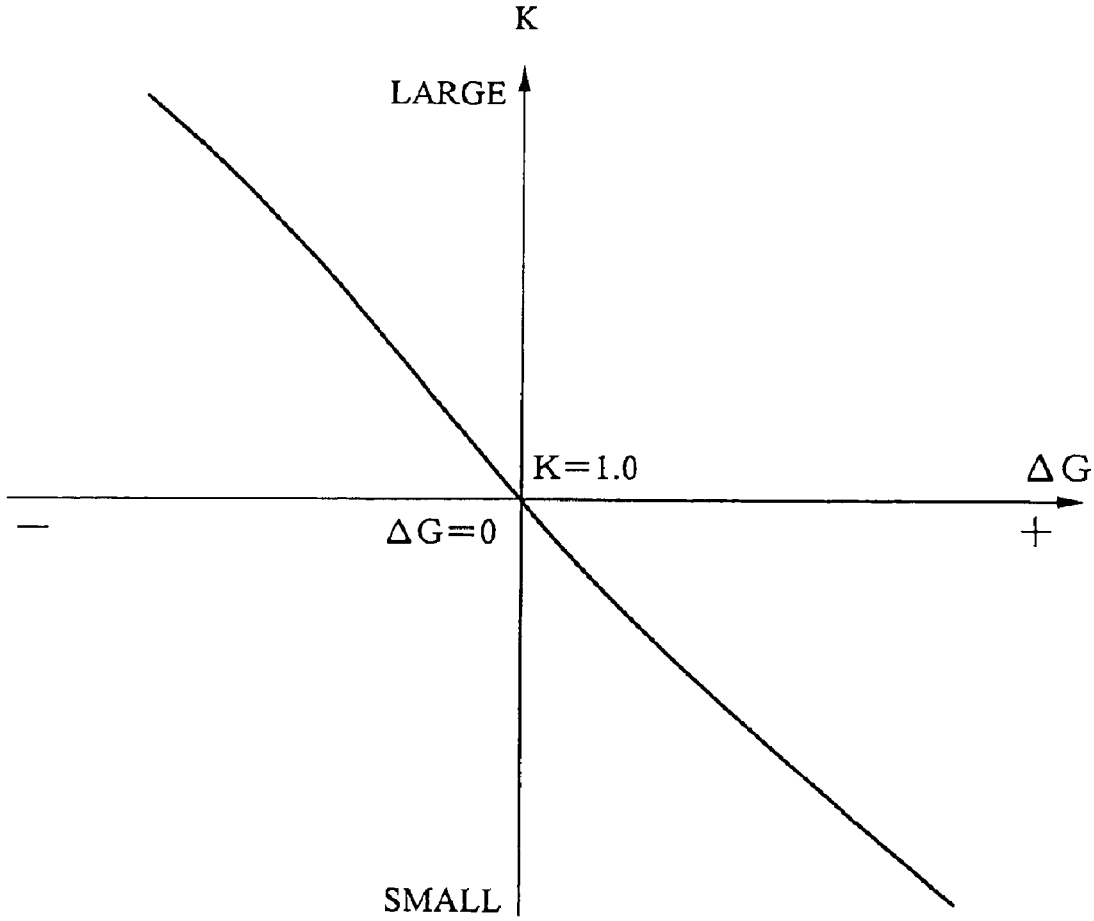
FIG. 8 is a diagram conceptually showing a map of a correction coefficient K.

Thereafter, the processing proceeds to step 217, searches a map of the correction coefficient K shown in FIG. 8, and calculates the correction coefficient K in accordance with the sensor error ΔG.

ECU 27 calculates the final detected air-fuel ratio λs by correcting the detected air-fuel ratio λs0 of the air-fuel ratio sensor 24 in shifting to the target air-fuel ratio by the following equation by using the correction coefficient K.

$$\lambda s=K\times(\lambda s0-1.0)+1.0$$

According to the first embodiment described above, when the target air-fuel ratio λtg is changed in executing the air-fuel ratio A/F control, the sensor error ΔG is learned based on the target air-fuel ratios λtg and the air-fuel ratio F/B correction coefficients FAF before and after the change, the detected air-fuel ratio λs0 of the air-fuel ratio sensor 24 is corrected by using the correction coefficient K calculated based on the sensor error ΔG. Therefore, even in an air-fuel ratio region in the rich control when the sensor error ΔG is increased, the air-fuel ratio detection accuracy of the air-fuel ratio sensor 24 can be promoted and promotion of the air-fuel ratio control accuracy and a reduction in exhaust emission can be realized.

Further, when the target air-fuel ratio λtg is changed between the value λtg1 at the vicinity of the stoichiometric air-fuel ratio (for example, 1.0) and the value λtg2 shifted in the direction richer than the stoichiometric air-fuel ratio (for example, 0.96), learning of the sensor error ΔG is executed. Therefore, the sensor error ΔG can be learned by using the air-fuel ratio F/B correction coefficient FAF1 in which influence of the sensor error is hardly included and the air-fuel ratio F/B correction coefficient FAF2 in which the influence of the sensor error is included and the sensor error ΔG can accurately be learned.

Further, as a timing of learning the sensor error ΔG executed by the sensor error and correction coefficient calculating routine of FIG. 4 through FIG. 6, the sensor error ΔG is learned not only in the rich control after finishing the fuel cut-off but also when the target air-fuel ratio is changed in a rich direction or in a lean direction other than the rich control. In this case, the sensor error ΔG may be learned only when the target air-fuel ratio Δtg is changed by a predetermined amount or more. Thereby, the sensor error ΔG can be learned only when the change amount of the target air-fuel ratio λtg becomes equal to or larger than a predetermined amount capable of sufficiently ensuring accuracy of learning the sensor error ΔG and accuracy of learning the sensor error can firmly be promoted.

However, the sensor error may naturally be learned only in the rich control after finishing the fuel cut-off.

(Second Embodiment)

Figure 9:
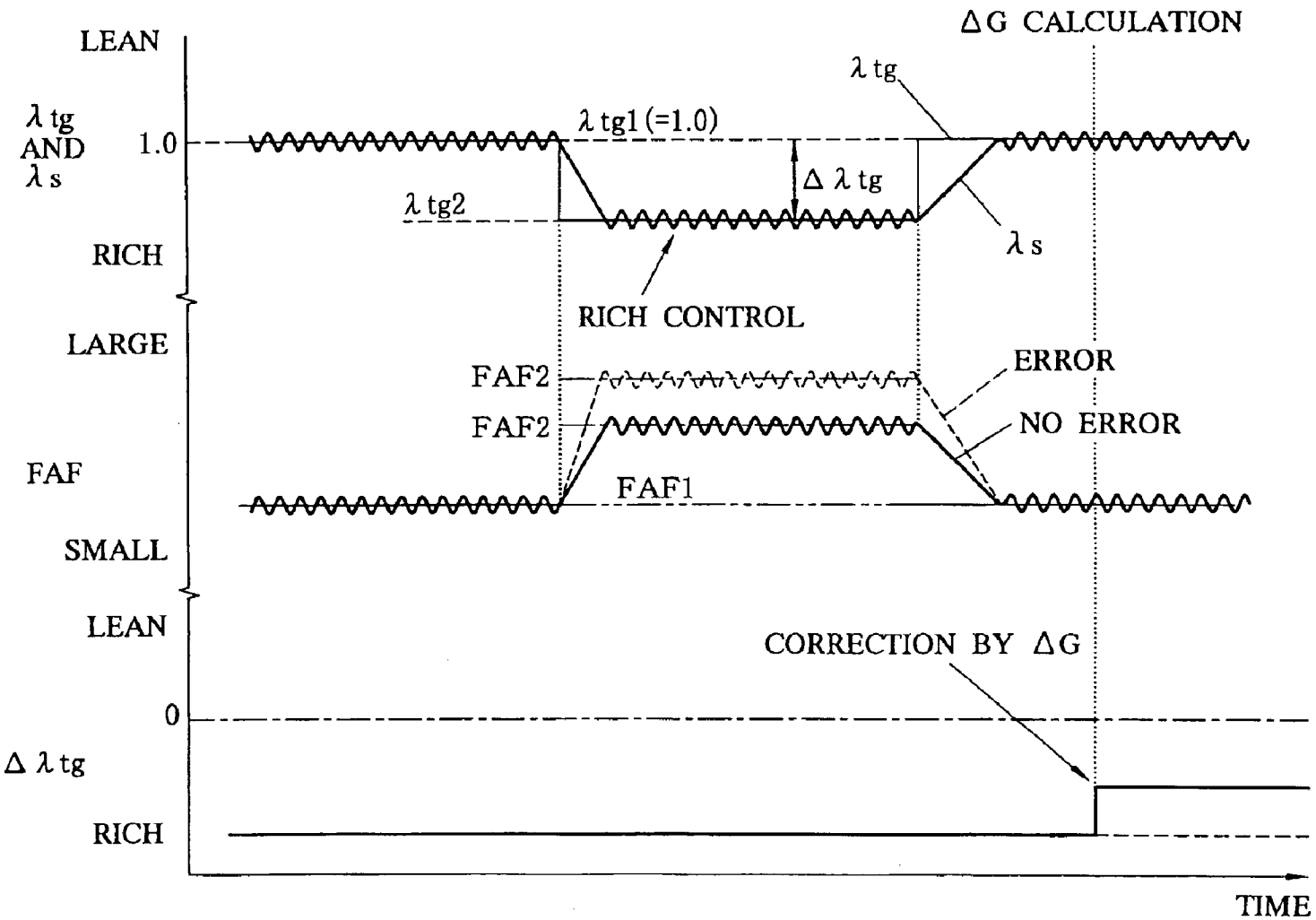
FIG. 9 is a time chart showing the second embodiment of the invention.

Although the detected air-fuel ratio λs0 of the air-fuel ratio sensor 24 in the rich control is corrected based on the sensor error ΔG in the rich control in the first embodiment, in the second embodiment shown in FIG. 9, the target air-fuel ratio λtg2 in the rich control is corrected by correcting a target air-fuel ratio shift amount Δλtg (=λtg2−λtg1) in the rich control based on the sensor error ΔG in the rich control. Or, the air-fuel ratio F/B correction coefficient FAF2 in the rich control may be corrected based on the sensor error ΔG in the rich control. In either of the cases, the target air-fuel ratio λtg2 or the air-fuel ratio F/B correction coefficient FAF2 in the rich control can be corrected to compensate for the sensor error ΔG in the rich control and the actual air-fuel ratio can accurately be controlled to the inherent target air-fuel ratio.

Further, although in the above embodiments, the sensor error ΔG is learned when the target air-fuel ratio λtg is changed from a state of being controlled to the target air-fuel ratio λtg2 in the rich control to the target air-fuel ratio λtg1 at normal time, that is, when the target air-fuel ratio λtg is changed from the rich state to the stoichiometric air-fuel ratio. On the contrary, the sensor error ΔG may be learned when the target air-fuel ratio λtg is changed from a state of being controlled to the target air-fuel ratio λtg1 at normal time to the target air-fuel ratio λtg2 in the rich control, that is, when the target air-fuel ratio λtg is changed from the stoichiometric air-fuel ratio to the rich state.

The present invention should not be limited to the disclosed embodiments, but may be modified in many ways. For instance, the invention may be applied to a lean burn engine or a cylinder injection engine and the sensor error may be learned at each time of switching the target air-fuel ratio during the air-fuel ratio A/F control.

What is claimed is:

1. An air-fuel ratio control apparatus for an internal combustion engine, the air-fuel ratio apparatus comprising:

an air-fuel ratio sensor for detecting an air-fuel ratio of emission gas of the internal combustion engine;

air-fuel ratio controlling means for executing an air-fuel ratio feedback control such that the air-fuel ratio detected by the air-fuel ratio sensor coincides with a target air-fuel ratio;

sensor error learning means for learning a sensor error of an output of the air-fuel ratio sensor when the target air-fuel ratio is changed in executing the air-fuel ratio feedback control by the air-fuel ratio controlling means based on target air-fuel ratios and air-fuel ratio feedback correction coefficients before and after changing the target air-fuel ratio.

2. The air-fuel ratio control apparatus for an internal combustion engine according to claim 1, wherein the sensor error learning means learns the sensor error when the target air-fuel ratio is changed between the stoichiometric air-fuel ratio or a ratio at the vicinity thereof and an air-fuel ratio other than the stoichiometric air-fuel ratio or the value at the vicinity.

3. The air-fuel ratio control apparatus for an internal combustion engine according to claim 1, wherein the sensor error learning means learns the sensor error when the target air-fuel ratio is changed by a predetermined amount or more.

4. The air-fuel ratio control apparatus for an internal combustion engine according to claim 1, wherein the sensor error learning means learns the sensor error when the target air-fuel ratio is changed in a direction richer than the stoichiometric air-fuel ratio to remove oxygen adsorbed in a catalyst for cleaning an emission after finishing to cut a fuel.

5. The air-fuel ratio control apparatus for an internal combustion engine according to claim 1, wherein the air-fuel ratio controlling means executes the air-fuel ratio feedback control such that the air-fuel ratio detected by the air-fuel ratio sensor is corrected based on a learning value of the sensor error and the corrected air-fuel ratio coincides with the target air-fuel ratio.

6. The air-fuel ratio control apparatus for an internal combustion engine according to claim 1, wherein the air-fuel ratio controlling means executes the air-fuel ratio feedback control by correcting the target air-fuel ratio or the air-fuel ratio feedback correction coefficient based on a learning value of the sensor error.

* * * * *